US010827826B1

(12) United States Patent
Banna

(10) Patent No.: US 10,827,826 B1
(45) Date of Patent: Nov. 10, 2020

(54) ELECTRIC BODY SCRUBBER

(71) Applicant: Hussam Banna, Farmers Branch, TX (US)

(72) Inventor: Hussam Banna, Farmers Branch, TX (US)

( * ) Notice: Subject to any disclaimer, the term of this patent is extended or adjusted under 35 U.S.C. 154(b) by 106 days.

(21) Appl. No.: 16/258,240

(22) Filed: Jan. 25, 2019

(51) Int. Cl.
*A46B 13/02* (2006.01)
*A47K 7/02* (2006.01)

(52) U.S. Cl.
CPC ..... *A46B 13/02* (2013.01); *A47K 7/028* (2013.01); *A46B 2200/1006* (2013.01)

(58) Field of Classification Search
CPC ..... A46B 13/02; A46B 13/023008; A46B 2200/1006; A46B 13/023; A46B 13/008; A47K 7/04; A47K 7/043
USPC ..... 15/21.1, 28, 97.1
See application file for complete search history.

(56) References Cited

U.S. PATENT DOCUMENTS 3,988,799 A * 11/1976 Strickland ..... A47K 7/04 15/97.1
4,027,348 A * 6/1977 Flowers ..... A46B 13/02 15/22.1
4,858,600 A * 8/1989 Gross ..... A61H 15/0085 601/159
5,415,621 A * 5/1995 Campbell ..... A61H 7/004 601/112
6,732,394 B1 * 5/2004 Waterman ..... A47K 7/04 15/97.1
7,572,238 B2 * 8/2009 Rhoades ..... A45D 34/041 601/138
8,726,528 B2 * 5/2014 Lyles ..... B26B 19/3853 30/526
9,038,224 B1 * 5/2015 Esquibel ..... A46B 13/023 15/22.1
9,486,065 B2 * 11/2016 Vejar ..... A47L 11/4069
2011/0185521 A1 * 8/2011 Temple ..... A47K 7/00 15/110
2016/0235258 A1 * 8/2016 Zhao ..... A47K 7/024

* cited by examiner

*Primary Examiner* — Joshua T Kennedy
(74) *Attorney, Agent, or Firm* — Jeffrey Roddy

(57) ABSTRACT

A body scrubbing device is controllable by a user's fingers such that the curvature of body contacting portion of the device may be made to conform to curved portions of the body. The device includes a motor, a power output shaft connected to the motor, a driven member and a flexible non-driven member adjacent the flexible driven member. The flexible non-driven member includes a bearing surface for contact with the driven member and a non bearing surface configured for contact with a user's fingers in permitting deformation the driven member into a curved disposition and the application of plural localized regions of pressure against the driven member and the contacting portion. Some implementations may include a wall mountable construction which may support the device for hands-free operation.

4 Claims, 8 Drawing Sheets

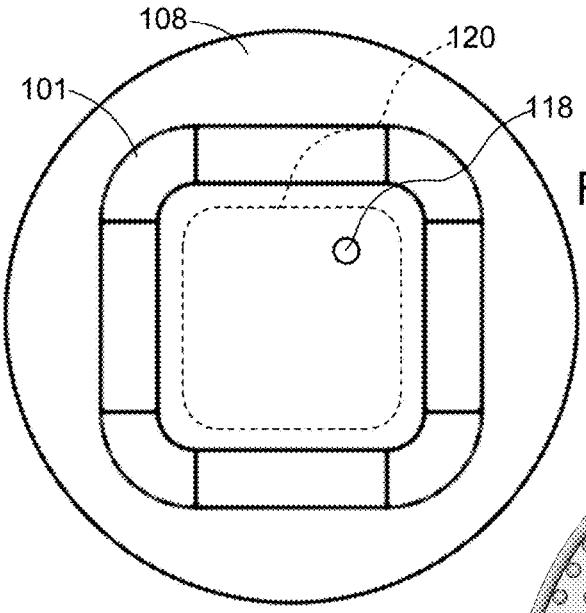
Fig. 7
Fig. 8A
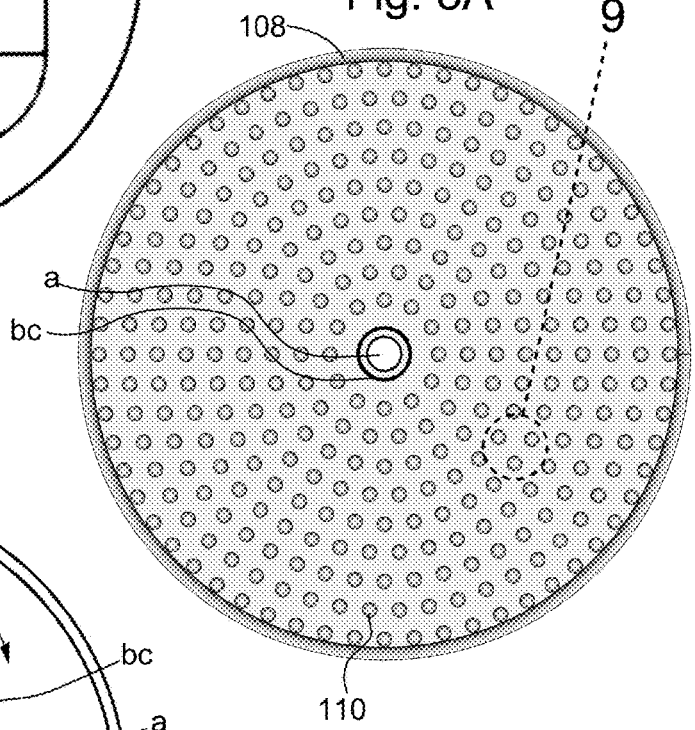
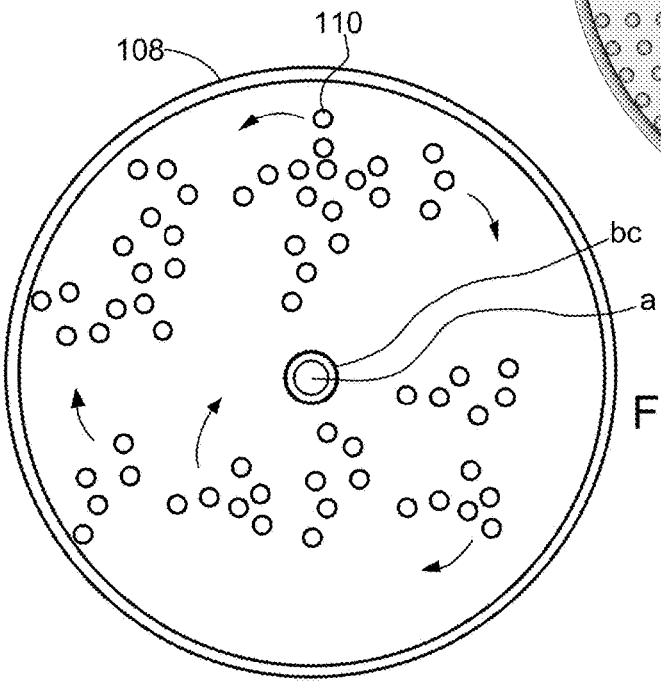
Fig. 8B

Fig. 12
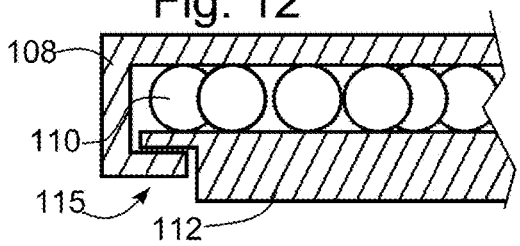
Fig. 13
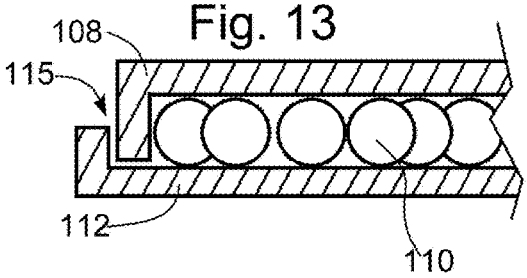
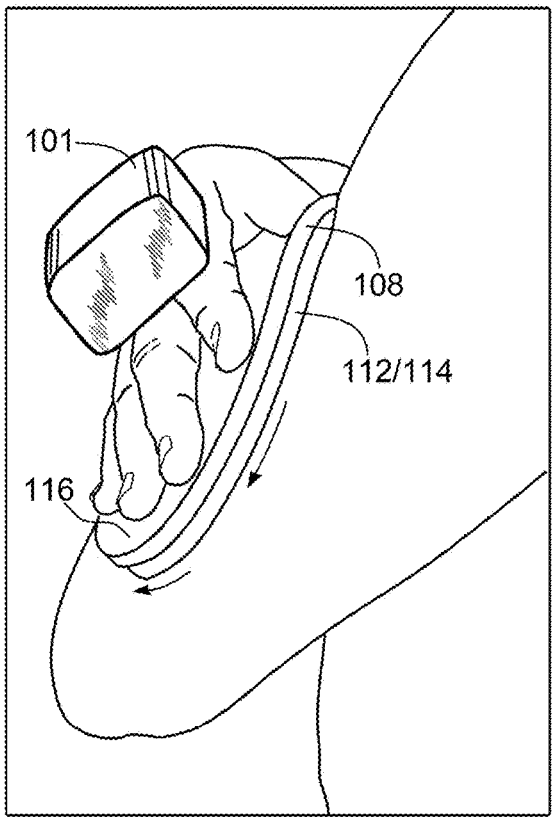
Fig. 14A
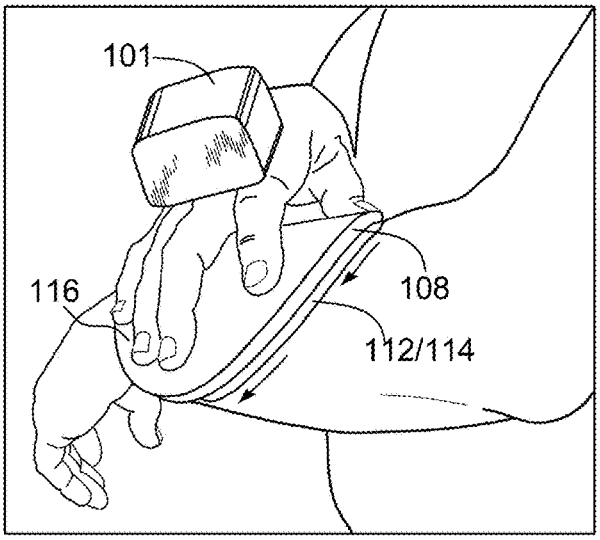
Fig. 14B

ELECTRIC BODY SCRUBBER

FIELD

The present invention relates generally to handheld electrically powered body scrubbing devices.

BACKGROUND

Corded or cordless electric body scrubbers of various sizes and configuration are well known in the art. Typically, such devices employ a mechanical movement to impart motion to a distal contacting portion of the device which may include a soft pad affixed to a relatively rigid substrate or mounting plate. The imparted motion may be elliptical, orbital, rotary, and by the employment of combined cams, may provide a multi-axis movement wherein a distal portion may both rotate, extend, and retract rapidly to produce an irregular orbital motion. Irrespective of the particular mechanical movement employed in the foregoing devices, motion imparted by the mechanical shaft or other linkages uniformly affects the distal contacting portion. Although such devices are useful for their intended purpose, uniform scrubbing across curved body surfaces, e.g., the forearms or biceps, can be difficult and time consuming because the contacting portion is generally rigid, planar, and fails to encompass curved body surfaces.

It would be desirable to provide a device wherein contacting portions of a body scrubbing device are responsive to movement of a user's fingers and palm.

It would be desirable to provide a device wherein the shape of the contacting portion may be altered by a user's fingers and palm to provide a particular contour for optimized contact of a body surface.

It would be desirable to provide a device wherein the contacting portion is configured to flex and more particularly, curve, in response to movement of a user's fingers and palm.

SUMMARY

The present invention relates generally to a body scrubbing device in which the curvature of a rotating body contacting member is controllable by a user's fingers and palm by applying pressure to a coaxially mounted flexible bearing plate in order to apply plural localized regions of pressure to a contoured surface such as those found on the human body. It should be noted that while particular implementations depicted in this disclosure include a circular contacting portion, any shape of pad may be used. Various implementations may include rotational movement at a constant or variable speed RPM that may be any RPM, but is normally in the range of 50-80 RPM, or, an oscillating, multi-directional movement that includes a regular or an irregular motion of the pad. In the particular implementation depicted in this disclosure, a contacting pad is configured to attach to a driven member linked to an output shaft and a mechanical movement connected to an electric motor.

In one general example implementation, a body scrubbing device includes a geared motor, a power output shaft, a driven member and a flexible bearing plate that includes a non-bearing side of the bearing plate adapted for contact with a user's fingers and palm, and a bearing side that includes a plurality of bearing elements. The non-bearing side of the bearing plate includes a flexible material.

In an aspect combinable with any other aspect described herein, a power output shaft may pass through portions of the flexible bearing plate and the flexible bearing plate may move independently relative to the output shaft.

In an aspect combinable with any other aspect described herein, the flexible bearing plate may include an elastomeric material.

In an aspect combinable with any other aspect described herein, bearing elements may include ball bearings, roller bearings or other elements providing a low coefficient of friction.

In an aspect combinable with any other aspect described herein, non-flexing plural bearing elements may be disposed in an flexible elastomeric matrix.

In another aspect combinable with any other aspect described herein, an aggregate of non-fixed bearing elements may be loosely disposed between the flexible bearing plate and the driven member, wherein the aggregate of bearing elements are free to move about and are contained by an encircling sealing interface between the driven member and bearing plate.

Although implementations described herein are intended for use in body scrubbing, conceivably, some implementations according to the present invention may be adapted for use in other applications such as the application of semi-solid or fluid materials to a complex surface.

The foregoing and other objects, features, and advantages of the invention will become more apparent from the following detailed description, which proceeds with reference to the accompanying figures wherein the scale depicted is approximate.

BRIEF DESCRIPTION OF THE DRAWINGS

FIG. 7 is a top plan view thereof;

FIG. 8A is a bottom plan view of a flexible bearing plate with fixed position bearing elements;

FIG. 8B is a bottom plan view of a flexible bearing plate with free (non-fixed) bearing elements;

FIGS. 12 and 13 are partial views of example sealing interfaces between the flexible bearing plate and the driven member;

FIGS. 14A and 14B are perspective views showing a typical environmental use of an example implementation according to the present invention;

DETAILED DESCRIPTION OF THE INVENTION

Reference Listing

Figure 1:
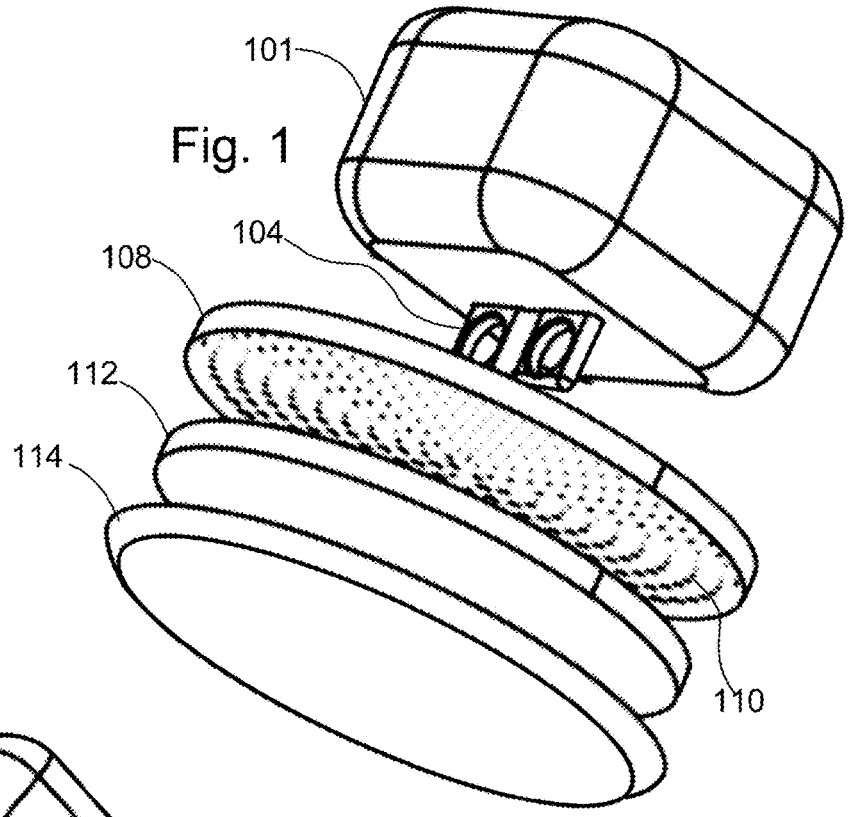
FIG. 1 is a exploded perspective view showing one implementation according to the present invention

100 body scrubbing device
101 motor housing

102 motor
103 battery
104 finger hold
105 mechanical movement
106 output shaft
107 sleeve
108 flexible bearing plate
109 elastomeric matrix
110 bearing element
111 ball bearing cup
112 driven member
113 bearing platform
114 contacting member
115 sealing interface
116 non-bearing side
118 charging jack
120 battery compartment
122 wall mountable support
124 adjustable wall mountable support

Definitions

In the following description, the term "motorized" means electric motor. The term "driven member" or "driven member" refers to an element that is connected to a powered mechanical movement that rotates or otherwise moves the plate which is applied against a surface which may be the surface of another plate. The terms "move," "movement," refer to any spinning, rotary, orbital, elliptical or oscillating movement. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1 through 16, a hand held body scrubbing device includes a motor 102, a water proof motor housing 101, a geared movement 105 powered by the motor, a power output shaft 106 with a sleeve 107 thereabout, a finger hold 104, a flexible bearing plate 108 circumjacent the power output shaft, plural bearing elements 110 mounted to—or constricted to a side of the flexible bearing plate, a flexible driven member 112 coupled to the power output shaft 106 and a contacting member/pad 114 configured to attach to the flexible driven member 112. When the device is powered, the output shaft moves the flexible driven member to which it is directly coupled—typically by a threaded nut (n). When the device is attached to the hand, fingers are placed through the finger hold 104 with the finger tips and/or palm placed against the non-bearing side 116 of the flexible bearing plate in order to apply pressure to the flexible bearing plate and adjust the curvature thereof in real time in order to exert pressure on the flexible driven member 112 which includes a surface adapted to receive the contacting member 114. The contacting member 114 may be a flexible pad of any material; e.g., loofah, suited for contact with the body. Other suitable materials for the flexible pad may include elastomers, non-woven fiber, absorbent/adsorbent and non-absorbent materials/fabrics, pile fabrics, hide, and natural or artificial furs whether used separately or in combination. Mechanical movement 105 is typically disposed between the motor and the output shaft 106 which drives driven member 112 at a speed which may be adjustable by the user. Movement 105 may include reduction gearing and may be geared in such a way to produce simple rotary movement or include cams to produce variations on simple rotary motion, oscillating and/or orbital motion which is then imparted to the driven member. Contacting member/pad 114 may be interchangeable and attached to the driven member by hook and loop fasteners, adhesives, magnets or any suitable attachment. Typically, plural bearing elements 110 may be metallic or non-metallic ball bearings in cup mounts mounted to a side of the flexible bearing plate 108 with the relatively rigid bearing elements 110 separated by a flexible matrix; e.g., rubber, which allows a user to bend the flexible bearing plate 108 into an arc. Alternately, a loose aggregate of bearing elements may be sandwiched between the flexible bearing plate and the driven member—in which case the device may include a sealing interface 115 or a locking interface for bearing containment between the plates. The flexible bearing plate is not coupled to the power output shaft or the driven plate. Further, the flexible bearing plate may be connected or unconnected to sleeve 107, and may be in a fixed position or manually rotatable. Because the back side of the driven member 112 abuts the bearing side of the flexible bearing plate 108, when the flexible bearing plate is formed into an arc by a user's fingers, the driven member in coaxial alignment with the flexible bearing plate and the contacting pad are likewise forced into a curved disposition while still permitting free rotation of the driven member. By example and not limitation, practical limits to the curvature of the flexible bearing plate may be obtained by employing an elastomeric material (Butyl rubber, Neoprene, Silicone, Thermoplastic elastormers (TPE) etc.,) having a suitable durometer value; e.g., 50-95 Shore A; 30-60 Shore D. In combination with the foregoing material(s), flexibility may be further limited by plate thickness; e.g., 2-8 mm.

Figure 2:
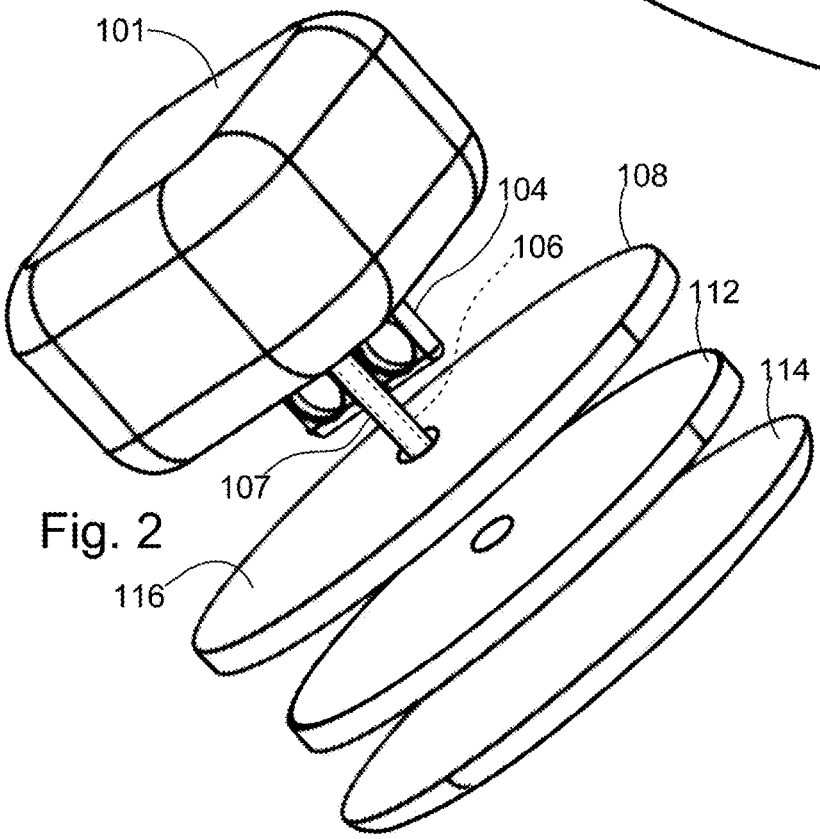
FIG. 2 is another exploded perspective view thereof.

FIGS. 1 and 2 depict exploded views of an example implementation showing the various elements; water proof motor housing 101, finger holds 104, power output shaft 106, flexible bearing plate 108, driven member 112 and contacting member/pad 114. FIG. 1 also shows bearing elements 110 mounted to or embedded in one side of the flexible bearing plate. Power output shaft is not coupled to the flexible bearing plate, but passes through a central annulus (a) of plate 108 which may include a loose fitting bearing collar (bc). Diameter of the output shaft 106 can vary and includes a sleeve 107 surrounding the shaft 106 to protect the user's fingers. It should also be noted that in lieu of the molded finger holds shown, one or more elastic bands or other elements may be employed as finger holds. In some implementations, as will be appreciated by those having skill in the art, it is possible that the water proof motor housing may not be centrally inline with the output shaft as depicted, but offset. For example, it is possible that the motor housing be mountable to the back of a user's hand or a user's wrist. Such implementations may include a powered gear box in the water proof motor housing which is configured to reside behind the user's fingers with the output shaft extending from the gearbox and to the driven member.

Figure 3:
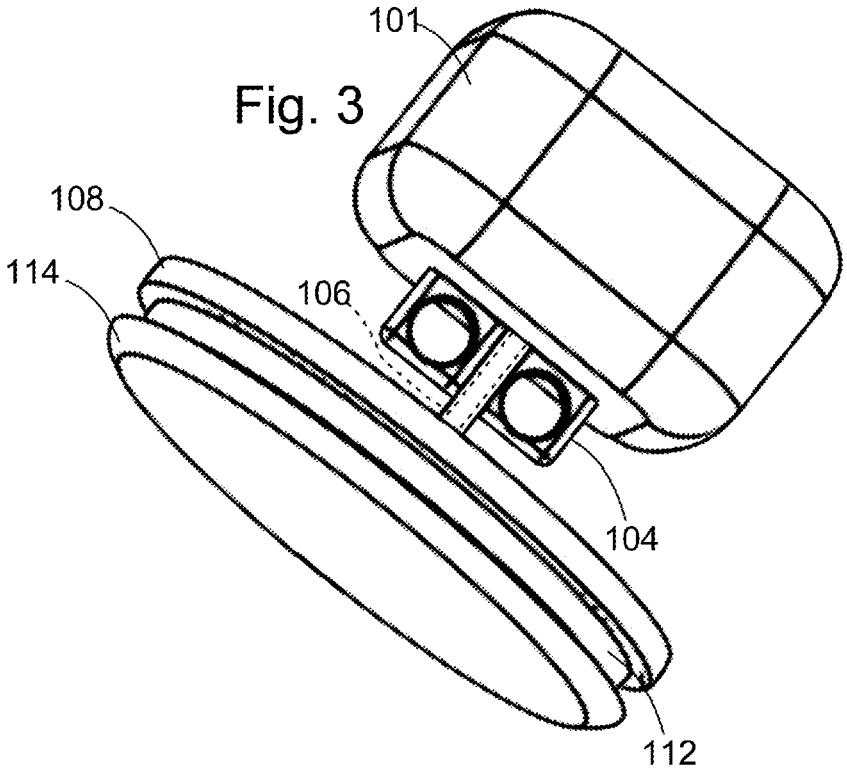
FIG. 3 is a normal perspective view thereof.
Figure 4:
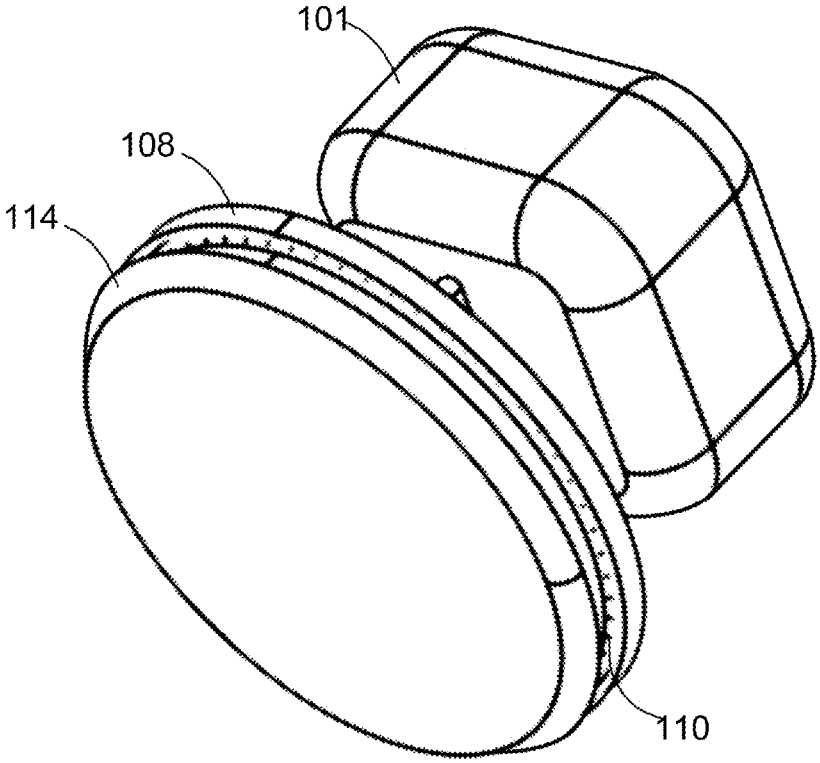
FIG. 4 is another perspective view thereof.

FIGS. 3 and 4 show plates (flexible bearing plate 108, driven member 112 and contacting pad 114) stacked in a normal position. Clearances between the flexible bearing plate and the driven member may vary according to the bearing width or diameter, etc. Water proof motor housing 101 contains an electric motor and a power transmission which includes a mechanical movement 105 connected via a gear box to the power output shaft 106 that extends from the housing. Regarding the motor powering source, the device may be corded to run off of normal household current or cordless. In the case of cordless operation, the motor housing may include a cavity for one or more batteries which may be rechargeable. In cases where the implementation includes a rechargeable battery, a power adapter/charger may be included. The electric motor can be any suitable type—brushed, brushless, permanent magnet, etc.

Figure 5:
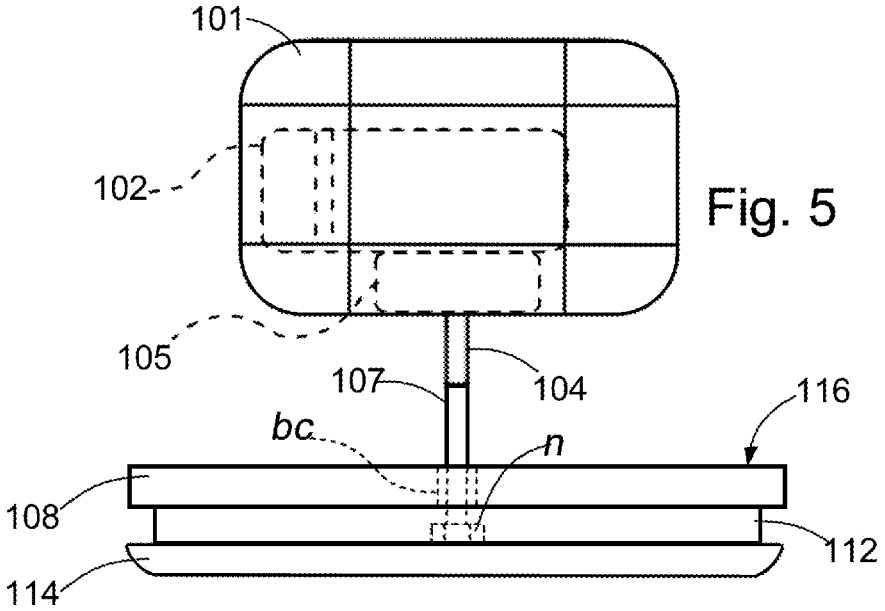
FIG. 5 is a side elevation thereof.
Figure 6:
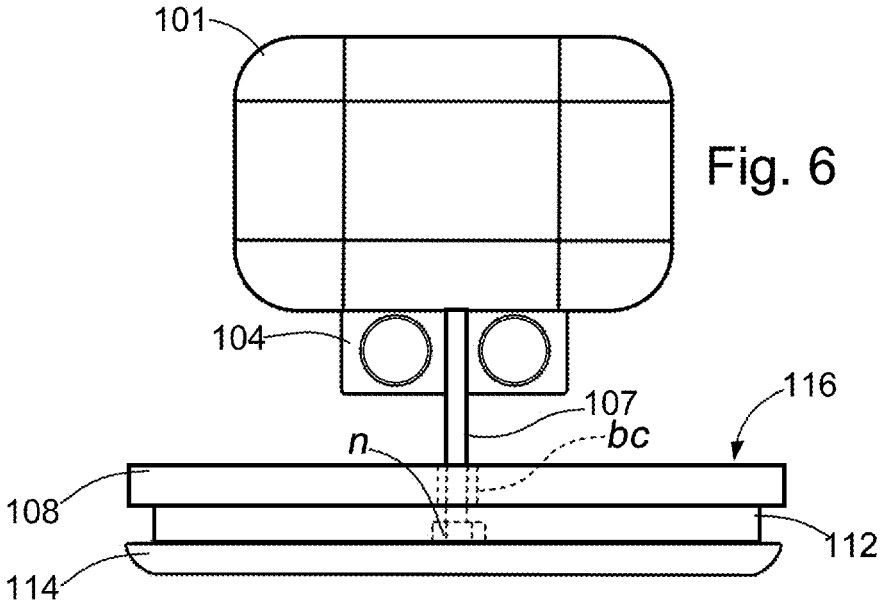
FIG. 6 is a side elevation 90 degrees relative to (FIG. 5)

FIGS. 5 and 6 show side elevations taken at 90° relative to each. Finger hold 104 is configured to receive two adjacent fingers of the hand; e.g., index and middle or middle and ring finger, which places the power output shaft in the trough between the fingers. Driven member 112 is engaged to the power output shaft 106 by retention nut (n) or any other suitable fastening member that will suggest itself to those having skill in the art.

FIGS. 7, 8A and 8B show respectively, a top plan view of the body scrubbing device 100, a bottom plan view of a flexible bearing plate 108 with fixed position bearing elements, and, a bottom plan view of a flexible bearing plate 108 with loose bearing elements that may move about freely and are disposed between the flexible bearing plate and the driven member. Loose bearing elements may be contained by a sealing interface 115 and/or a locking interface that includes an interlocking flange element on one or more plates.

Figure 9:
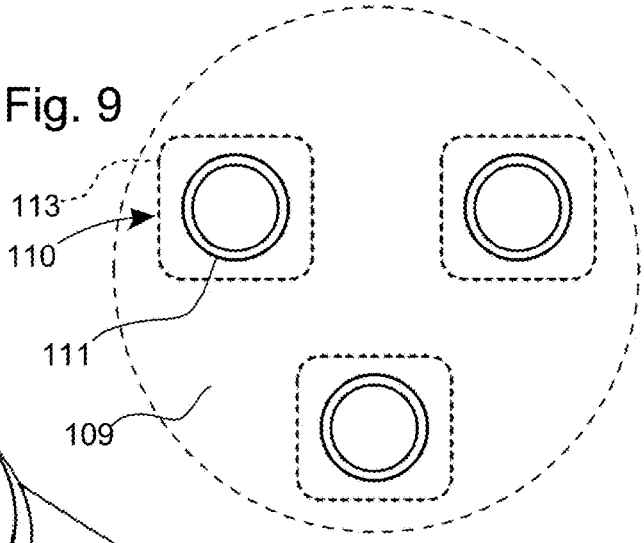
FIG. 9 is a detail view of call-out 10 of (FIG. 8A)

FIG. 9 is an enlarged detail view of call-out (10) of (FIG. 8A). While the particular implementation shown depicts a ball bearing configuration, it will be appreciated by those with skill in the art and access to this disclosure that other types of bearings such as roller bearings may be employed. Similarly, it is possible that the mating surfaces of the flexible bearing plate and the driven member include elements possessing a relatively low coefficient of friction such as graphite, Polytetrafluoroethylene, Polyoxymethylene, Polyethylene terephthalate, Nylon, etc.

Figure 10:
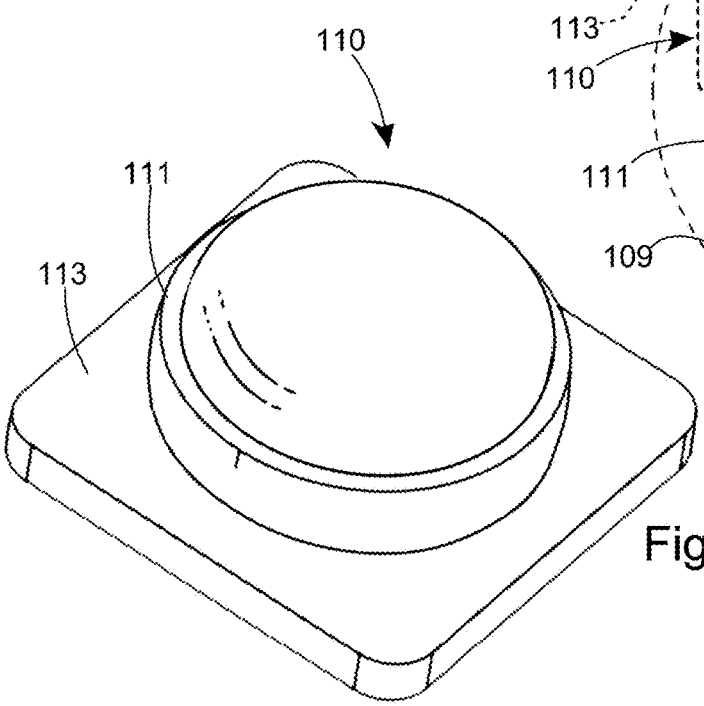
FIG. 10 is a perspective view of an example bearing element of a kind that may be embedded in an elastomeric matrix.

FIG. 10 depicts a perspective view of a single bearing element that includes a ball bearing, a bearing cup 111 and a platform 113. Multiples of such bearing elements may be embedded in an elastomeric matrix where the cup and ball bearing are exposed and the remainder of the bearing element is sealed within the matrix. Alternately, strips including plural bearing elements may be mounted on, or embedded in the flexible bearing plate in a radial or circular configuration.

Figure 11:
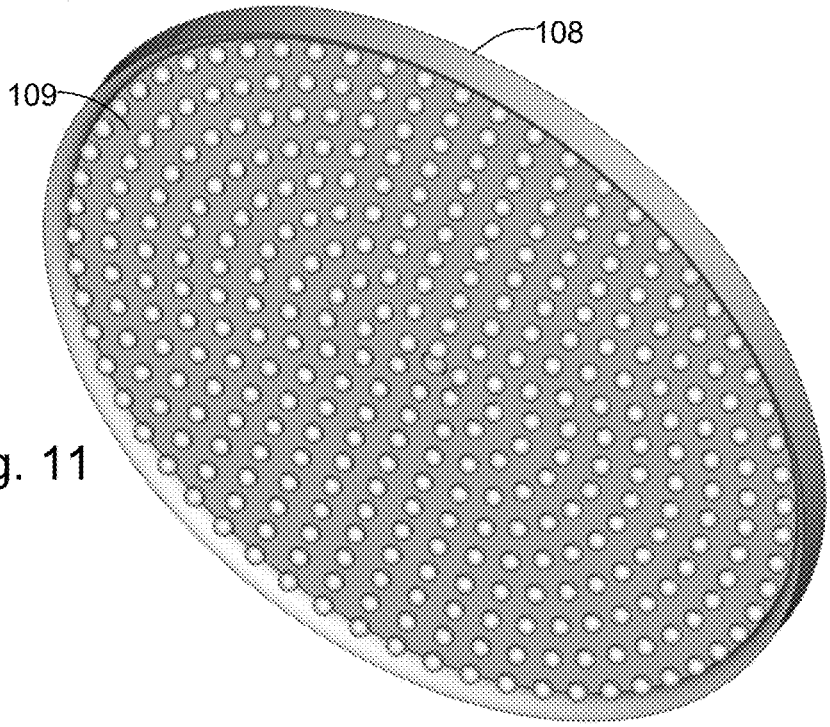
FIG. 11 is a perspective detail view of the flexible bearing plate with plural bearing elements.

FIG. 11 is a perspective view of a flexible bearing plate that includes plural fixed position bearing elements. The bearing plate may include a circumferential lip on the bearing side as shown. The flexible bearing plate may be of greater diameter or lesser diameter than the driven member in cases where free bearings are employed.

FIGS. 12A and 12B in partial views, show possible sealing interfaces between the driven member 112 and the flexible bearing plate 108 configured to contain free bearing elements 110. In some cases, the driven member may include a flange that engages or interlocks with a portion of the flexible bearing plate. In some cases, the driven member and the flexible bearing plate may be held together by a nut or crimp affixed to the shaft sleeve 107. The elasticity of the driven member and the flexible member may be different, with the flexible bearing plate being stiffer or more elastic than the driven member.

FIGS. 14A and 14B illustrate a typical use for an example implementation where the curvature of the flexible bearing plate, and the flexible driven member and contacting member is manipulable by a user's fingers and palm when placed against the non-bearing side of the flexible bearing plate.

Figure 15A:
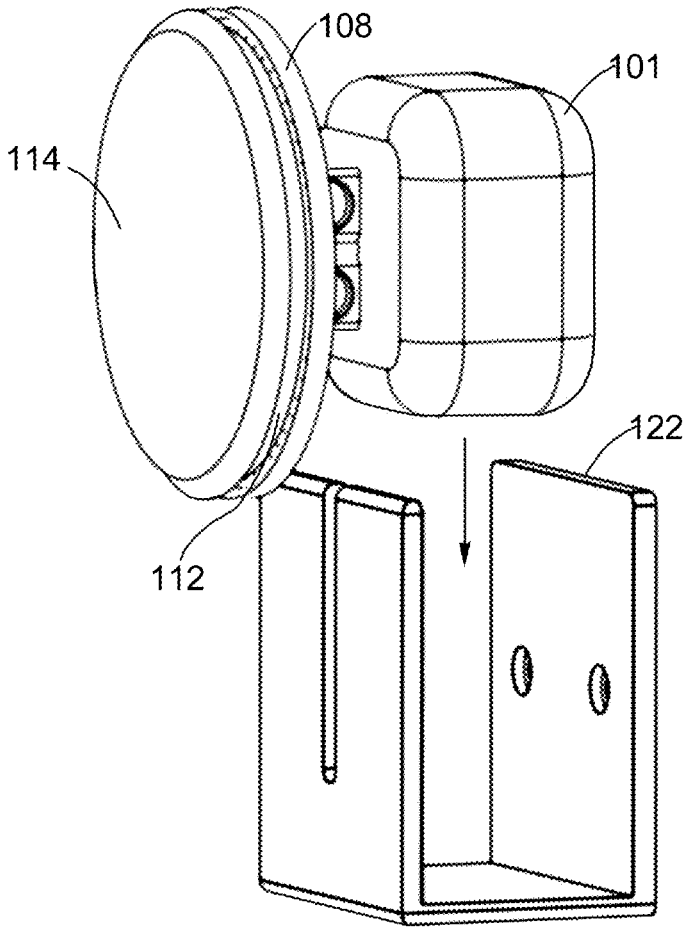
FIGS. 15A and 15B show an example implementation supportable in a wall mounted support.
Figure 15B:
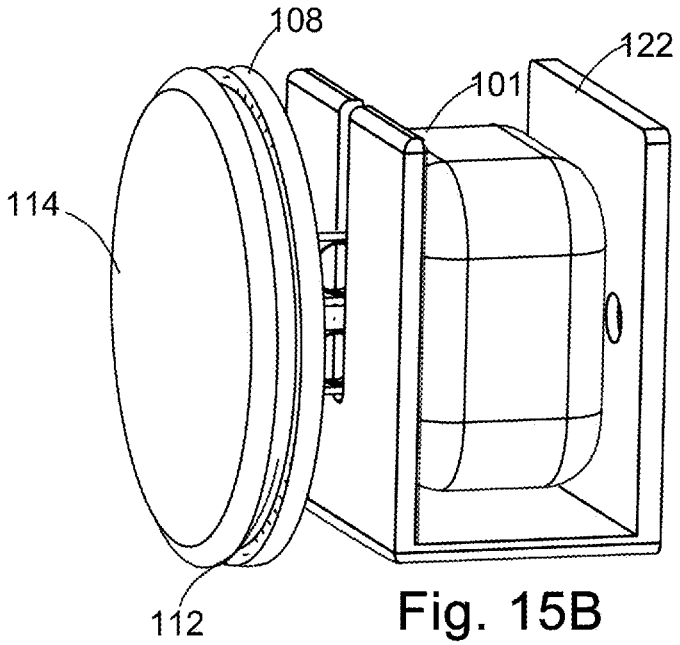
Figure 16:
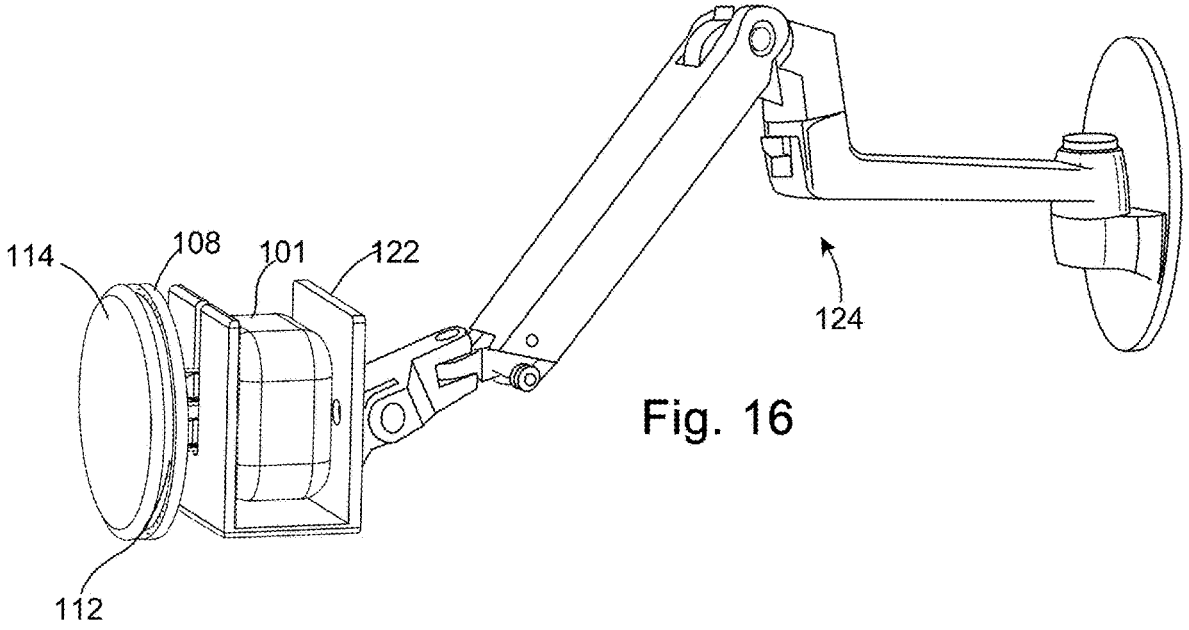
FIG. 16 shows the implementation of 15A and 15B supported by a wall mounted arm.

FIGS. 15A and 15B show an example implementation that may be placed in a wall mountable support 122 to facilitate hands-free scrubbing operation. The wall mountable support may be attached to the wall by threaded fasteners, adhesive or any other suitable attachment element. Other supportive constructions for the device will be appreciated by those having skill in the art. FIG. 16 shows an example implementation of a mountable support that is height and angularly adjustable.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. A body scrubbing device comprising:

a geared motor connected to a power output shaft, the geared motor disposed within a water proof housing;

a flexible driven member connected to the power output shaft;

a manually flexible bearing plate circumjacent the output shaft, including a bearing side with a plurality of bearing elements and a non-bearing side, the flexible driven member interfaced with but configured to rotate independently of the flexible bearing plate about the output shaft;

a space disposed between the flexible bearing plate and the motor adapted for the placement of fingers of a user's hand; and, the manually flexible bearing plate configured to conform the driven member into a continuously curved disposition based on pressure applied by the user's palm or fingers to the non-bearing side of the flexible bearing plate, the flexible bearing plate adjustable by the pressure applied into a curved disposition such that the driven member is circumferentially conformable to portions of a user's body.

2. The device according to claim 1, further comprising an elastic pad portion affixable to the driven member.

3. The device according to claim 1, further comprising an exfoliating element.

4. The device according to claim 1, further comprising a grip portion disposed in the space between the flexible bearing plate and the motor.

* * * * *